United States Patent [19]

Zandelin

[11] 4,187,631

[45] Feb. 12, 1980

[54] CARD INDEX

[75] Inventor: Ernst E. Zandelin, Sollentuna, Sweden

[73] Assignee: Sony Corporation, Tokyo, Japan

[21] Appl. No.: 882,460

[22] Filed: Mar. 1, 1978

[30] Foreign Application Priority Data

Mar. 2, 1977 [SE] Sweden ..... 7702299

[51] Int. Cl.[2] ..... B42F 17/34

[52] U.S. Cl. ..... 40/381

[58] Field of Search ..... 273/149 R, 149 P; 40/381, 322, 383, 336

[56] References Cited

U.S. PATENT DOCUMENTS

| | | | |
|---|---|---|---|
| 449,316 | 3/1891 | Falkingham | 273/149 R |
| 2,760,839 | 8/1956 | Martin | 40/383 |
| 3,167,371 | 1/1965 | Parcher et al. | 40/381 |
| 4,058,920 | 11/1977 | Moltrecht | 40/336 |
| 4,064,643 | 12/1977 | Greif | 40/381 |
| 4,070,776 | 1/1978 | Mitsuhashi | 40/382 |

*Primary Examiner*—Louis G. Mancene
*Assistant Examiner*—Wenceslao J. Contreras
*Attorney, Agent, or Firm*—Lewis H. Eslinger; Alvin Sinderbrand

[57] ABSTRACT

A telephone subscriber's card index includes a flat casing having a top, side walls and a front opening, a tray adapted to be pushed into and pulled out of the casing through said opening, and a pile of index cards supported on the tray and intended to have information thereon. The index includes manually operable depressible keys, with dogs on the underside of the keys, for determining, before pulling out the tray, which index card is to be presented to an operator by depression of an optionally selected one of said keys.

10 Claims, 8 Drawing Figures

CARD INDEX

The present invention relates to a card index of the type which includes a number of index cards arranged in a pile on a tray which can be pushed into and pulled out of a casing. By way of a simple movment of the hand any index card may be selected and presented to the person handling the card index. A preferred embodiment of the invention is a telephone index forming a base for a desk telephone and including index cards on which the telephone numbers to the various subscribers may be written down.

The card index according to the invention is of the type which includes a flat casing having a top, side walls and a front opening through which a tray intended to support a pile of index cards upon which for example the numbers of telephone subscribers may be written down can be pushed into and pulled out of the casing, the index being also provided with a manually operable device for determining, before pulling out the tray, which index card is to be presented to the person handling the index. As distinct from other indexes of this type, the card index of the present invention is characterized by a step provided on the tray beyond which step the front margins of the index cards, which margins each are provided with a cutout the breadth of which increases from one card to the next one, project some distance, a number, corresponding to the number of index cards in the pile, of manually depressible keys having a dog or corresponding means are provided in the casing which dogs at the depression of the key passes down through a corresponding cutout provided in the front margin of the casing top and thereby at some distance in front of the step of the tray depresses the front portion of a number of index cards in the pile corresponding to the key selected, which cards thereby temporarily assume a curved form which results in the cards of the pile lying thereabove being pressed upwards into engagement with the inside of the casing top. These cards at the pulling-out of the tray, and those cards retained against the same by the dog of the key or corresponding means, from the casing, remain by their front ends being stopped by catch means provided at the underside of the front margin of the top between the cutouts therein.

For the elucidation of the invention it is referred to an example of construction illustrated in the attached drawing.

Figure 1:
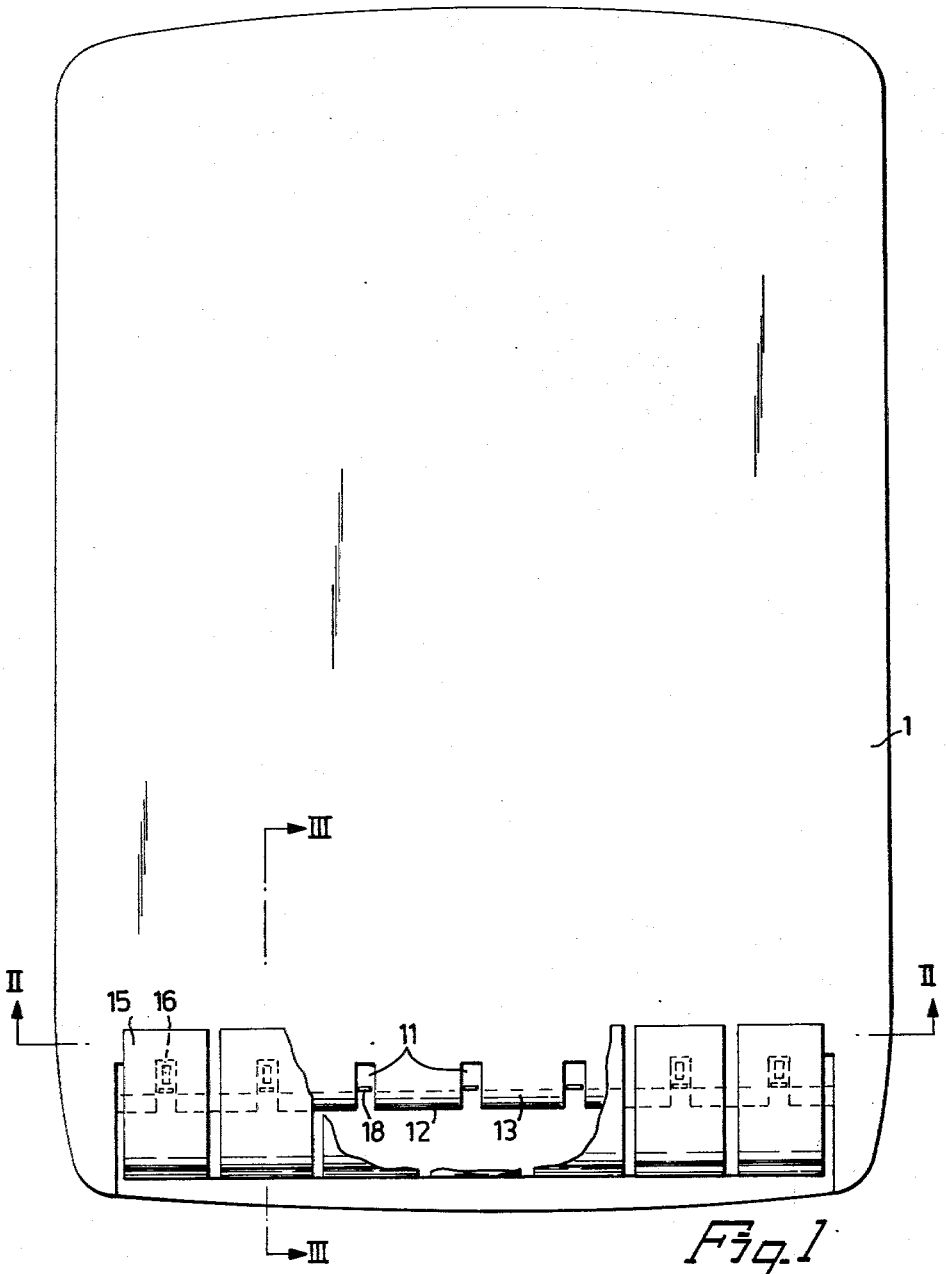
FIG. 1 is a plan view of a card index in the form of a telephone index according to the invention.
Figure 2:
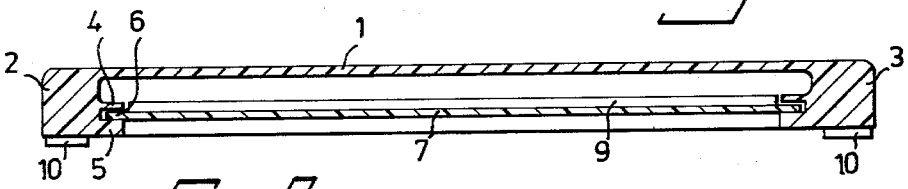
FIG. 2 shows a transverse section through the front portion of the index along the line II—II in FIG. 1.
Figure 3:
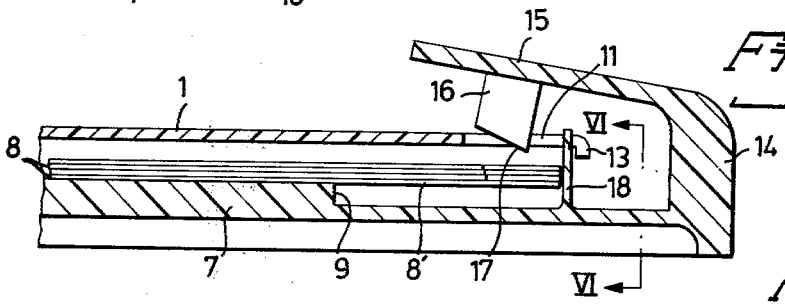
FIG. 3 shows a longitudinal section through the front portion of the index along the line III—III in FIG. 1, before any key has been depressed, i.e. before any selection on an index card has taken place.

In FIGS. 1 and 2, 1 designates a flat box-shaped casing which has no front short side and which preferably may be open in the downdirection. On the inside of the longitudinal side walls 2 and 3 of the casing there are provided guides 4 and 5 for corresponding strip-shaped margins 6 of a tray 7 which can be pushed into the casing 1 from the open front side and is intended to receive a pile 8 of index cards. On the tray 7 near the front end thereof there is provided a sharp step 9 of a height of some millimeters, beyond which the pile 8 of cards projects, as shown in FIG. 3.

In the embodiment shown, the casing 1 preferably rests on low feet 10 of any suitable material which does not scratch an easily damaged table top surfaces, and at its front edge (see FIG. 1) the top of the casing 1 has a number of spaced narrow rectangular cutouts 11 between which there remain relatively broad rectangular tabs 12. On the underside of each tab 12, at the front end of the tab, there is fixed a strip-shaped stop or catch member 13 for a purpose stated more in detail in the following.

An upright portion terminating the front end of the tray 7 or a front edge portion 14 supports a number of depressible keys 15. The keys may be mounted on an axle carried by the front edge portion 14 and be actuated by springs which tend to keep them in the raised position shown in FIG. 3. They may also be applied to leaf springs which keep them raised. In the form of construction shown in FIGS. 3 and 4 the keys are made integral with the front edge portion 14 of the tray 7, which portion together with the tray consists of polypropene. It has been found that this material is well suited for the purpose and that the keys constructed therefrom function faultlessly, i.e. after depression to the position according to FIG. 4 automatically return to the position according to FIG. 3.

Figure 4:
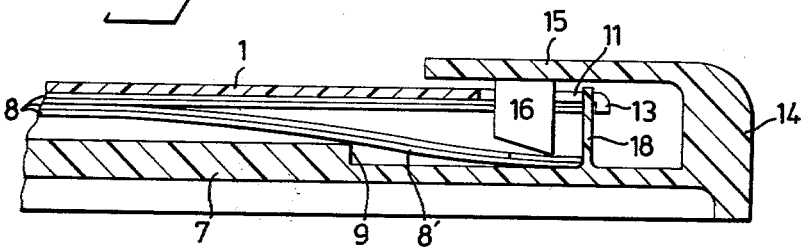
FIG. 4 shows a transverse section similar to that according to FIG. 3 with a key depressed for the selection of a certain index card which will be uppermost in the pile of cards which is taken along when the tray is pulled out of the casing.

On the underside of each key 15 there is preferably provided a dog 16 which may be bevelled on its underside, as shown at 17, so that a tip preferably pointing in the pull-out direction of the tray is formed. The dog 16 is intended at the depression of the key 15 to pass through a corresponding cutout 11 in the front margin of the casing top and then to bend down a number, corresponding to the key in question, of the index cards over the step 9 and to hold them against the tray 7. The bent-down cards then assume a curved form, as shown in FIG. 4, which curved form results in those cards of the pile thereabove being pressed upwards against the inside of the casing top. The tray 7 can now be pulled out of the casing 1 to the right in FIG. 4, the cards bent-down over the step 9 being carried along with it, while the upper part of the pile of cards is left behind in the casing by the front edges of the cards being held by the stop or catch strips 13.

Figure 7:
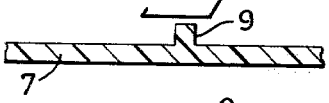
Figure 8:
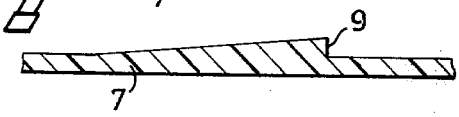

FIGS. 7 and 8 show alternative constructions of the tray 7 with its step 9. According to FIG. 7, on the top of the tray there is mounted a transverse strip the front edge of which forms the desired step, and according to FIG. 8, on the top of the tray there is formed a ramp which is terminated by the sharp step 9. In both of these constructions of the tray the pile of cards will normally occupy a position sloping forwardly-upwardly with the front edges situated opposite the stop or catch strips 13 at the front margin of the casing top. Thereby, the strips effectively prevent the pulling-out of index cards as long as no key 15 has been depressed.

Figure 5:
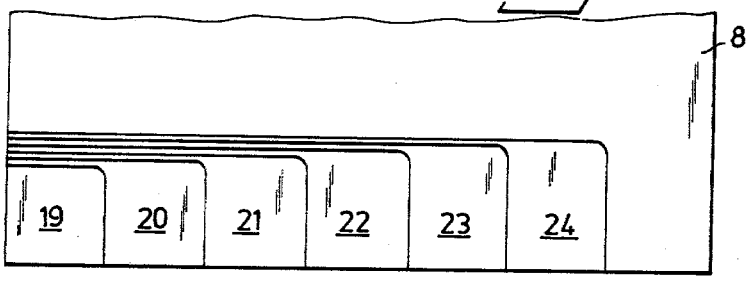
FIG. 5 is a plan view of the front portion of a pile of index cards for use in the index and representing the various rectangular cutouts at the front margins of the cards which enable the selection of cards by depression of the keys.

The card index may contain an optional number of index cards but it is of course suitable to limit the number of such cards by allowing subscriber names, accounts or the like, which being with several different letters, e,g, the group A, B, C and D, to be written on one and the same card. In the index shown in the drawing seven index cards 8 are used, as shown in FIG. 5. All of these cards have the same size and each of them except the first at its front edge has a rectangular cutout 19–24, the breadth of which increases from one card to the next card of the pile, so that a stepped layer arrangement is obtained.

At a depression of a key 15 the dog 16 of this key strikes the upper card within the corresponding square of the stepped layer arrangement in FIG. 5 at a point substantially at half the length of the index card tabs formed through the cutouts 19–24 and bends the card or cards down, as described above and as shown in FIG. 4. In FIGS. 3 and 4, for the sake of clearness only four cards are depicted, while in FIG. 6 the cards have been completely omitted. By having the dog applied at the said point of the tabs of the cards, after a long period of use, will assume a permanently upwardly curved condition which further insures safe function in the selection of index cards by improving the positioning of the cards against the catch strip.

According to a modification the pile of cards may, as the lowermost element, contain a sheet 8 of a particularly resilient material, such as steel, plastic or cardboard, which sheet contributes to producing the necessary curved bending of the cards shown in FIG. 4.

Figure 6:
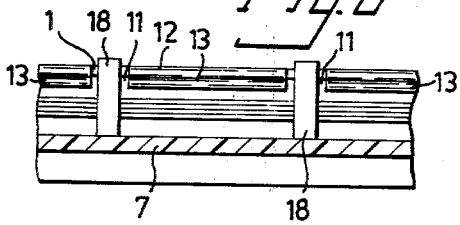
FIG. 6 shows, as seen in direction of the arrow, a detailed section along the line VI—VI in FIGS. 7 and 8 show other ways of forming the necessary steps in the card tray.

In FIGS. 3, 4 and 6, a lower pushing-in member 18 is shown on the tray 7 near the front ends of the bent-down index cards, which member guarantees restoring of the cards at the pushing-in of the tray into the casing. This pushing-in member may, as shown in FIG. 6, preferably include a number, corresponding to the number of cutouts 11 in the front margin of the casing top, of vertical bars 18 at the pushing-in of the tray into the casing are moved into the cutouts 11. The bars 18 extend upwards to a point slightly above the front margin of the casing top.

The index may be molded in only two parts, one part including the casing with cutouts and catch members and the other including the tray with the step, the keys and the pushing-in members.

Finally, it may be mentioned that the index is not exclusively intended to be used as a telephone index, but it may be of use in other connections where it is desired to store information in a rapidly accessible way. Several card indexes may then be piled on each other.

Various modifications are of course conceivable within the scope of the invention.

What I claim is:

1. In a card index, a flat casing having a top, side walls and a front opening, a tray mounted to be pushed into and pulled out of the casing through said opening, said tray having a step between a rear part and a front part thereof, a pile of index cards supported on said tray and intended to have information written thereon, the front margins of said cards extending beyond said step, manually operable means for determining, before pulling out said tray, which index card is to be presented to an operator, said means comprising manually depressible keys in a number corresponding to the number of index cards in said pile and dog means on said keys adapted at the depression of said keys to pass down through corresponding cutouts in the front margin of the casing top and at some distance in front of said step to bend down towards the front portion of the tray, the front portion of a number of said index cards corresponding to optionnally selected keys, thereby causing the remaining index cards lying thereabove to be pressed upwards into engagement with the inside of said casing top, and catch means at the underside of said casing top between said cutouts therein to stop said remaining index cards when pulling out said tray together with the bent-down index cards.

2. A card index as claimed in claim 1, in which said catch means consists of transverse strips.

3. A card index as claimed in claim 1, in which said pile of index cards includes a base sheet of resilient material.

4. A card index as claimed in claim 1, in which said step is formed by a transverse strip provided on the top of the tray.

5. A card index as claimed in claim 1, in which said step is formed as the termination of a ramp on the rear part of the tray.

6. In a card index, a flat casing having a top, side walls, and a front opening, a tray mounted to be pushed into and pulled out of the casing through said opening, said tray having a step between a rear part and a front part thereof, a pile of index cards supported on said tray and intended to have information written thereon, the front margins of said cards extending beyond said step, manually operable means for determining, before pulling out said tray, which index card is to be presented to an operator, said means comprising manually depressible keys in a number corresponding to the number of index cards in said pile and dog means on said keys adapted at the depression of said keys to pass down through corresponding cutouts in the front margin of the casing top and at some distance in front of said step to bend down towards the front portion of the tray, the front portion of a number of said index cards corresponding to optionally selected keys, thereby causing the remaining index cards lying thereabove to be pressed upwards into engagement with the inside of said casing to catch means at the underside of said casing top between said cutouts therein to stop said remaining index cards when pulling out said tray together with the bent-down index cards, and a number, corresponding to the number of keys, of pushing-in means mounted on said tray immediately in front of the front ends of the index cards to move the bent-down cards back together with the tray when pushing-in the latter into the casing.

7. A card index as claimed in claim 6, in which each pushing-in means includes an upright bar.

8. A card index as claimed in claim 6, in which each pushing-in means includes an upright bar on said tray of a length such that it at least enters the cutouts in the front margin of the casing top.

9. A card index as claimed in claim 1, in which each of the dog means which are mounted on the underside of said keys has its bottom end bevelled so as to press the bent-down cards against the tray by means of its lowermost tip pointing in the pull-out direction of the tray.

10. A card index as claimed in claim 1, in which each of the dog means which are mounted on the underside of said keys is of a form such that at the depression of the key associated therewith it is applied to a point of the index cards located substantially at half the length of tabs on said cards defined by the cutouts in the latter.

* * * * *

UNITED STATES PATENT OFFICE

CERTIFICATE OF CORRECTION

Patent No. 4,187,631 Dated February 12, 1980

Inventor(s) ERNST EGON ZANDELIN

It is certified that error appears in the above-identified patent and that said Letters Patent are hereby corrected as shown below:

"On the cover delete the assignee"

Signed and Sealed this

Sixth Day of April 1982

(SEAL)

Attest:

GERALD J. MOSSINGHOFF

Attesting Officer

Commissioner of Patents and Trademarks